United States Patent [19]

Hebert

[11] 4,185,929

[45] Jan. 29, 1980

[54] WIRE MATRIX PRINT HEAD ASSEMBLY

[75] Inventor: Donald G. Hebert, 9412 Cherry Hills La., San Ramon, Calif. 94583

[73] Assignees: Helmut Falk, Palo Alto; Donald G. Hebert, San Ramon, both of Calif.

[21] Appl. No.: 885,186

[22] Filed: Mar. 10, 1978

[51] Int. Cl.[2] ..... B41J 3/12

[52] U.S. Cl. ..... 400/124; 101/93.05

[58] Field of Search ..... 101/93.05; 400/124

[56] References Cited

U.S. PATENT DOCUMENTS

| | | | |
|---|---|---|---|
| 3,672,482 | 6/1972 | Brumbaugh et al. | 400/124 |
| 3,893,220 | 7/1975 | Bittner | 400/124 X |
| 4,004,671 | 1/1977 | Kondur | 400/124 |
| 4,047,606 | 9/1977 | Ott | 400/124 |
| 4,081,067 | 3/1978 | Schrag et al. | 400/124 |
| 4,091,909 | 5/1978 | Lee | 400/124 |

*Primary Examiner*—Paul T. Sewell

*Attorney, Agent, or Firm*—Bruce G. Klaas

[57] ABSTRACT

A wire matrix print head assembly having bearing and guide apparatus for a plurality of circumferentially spaced reciprocable wire members comprising one or more elongated bearing members each having a plurality of elongated passages, there being one passageway in each bearing member for each wire member and the passageways for each wire member in each bearing member being aligned and interconnected to provide a continuous wire passage receiving a majoral portion of each wire member and comprising in sequence a relatively long length enlarged first inlet and guide portion; a relatively short length intermediate second bearing portion; a relatively long length intermediate third guide portion; a relatively short length intermediate fourth bearing portion; a relatively long length intermediate fifth guide portion; and a relatively short length terminal sixth bearing portion, the guide portions enabling continuous uninterrupted slidable insertion of the wire member during assembly while also enabling free reciprocating movement of the wire member after assembly without circumferentially restrictive contact with the surfaces of the guide portions and the bearing portions also enabling continuous uninterrupted slidable insertion of the wire member during assembly while also providing circumferentially restrictive bearing support for relatively short length axially spaced portions of the wire members after assembly.

25 Claims, 12 Drawing Figures

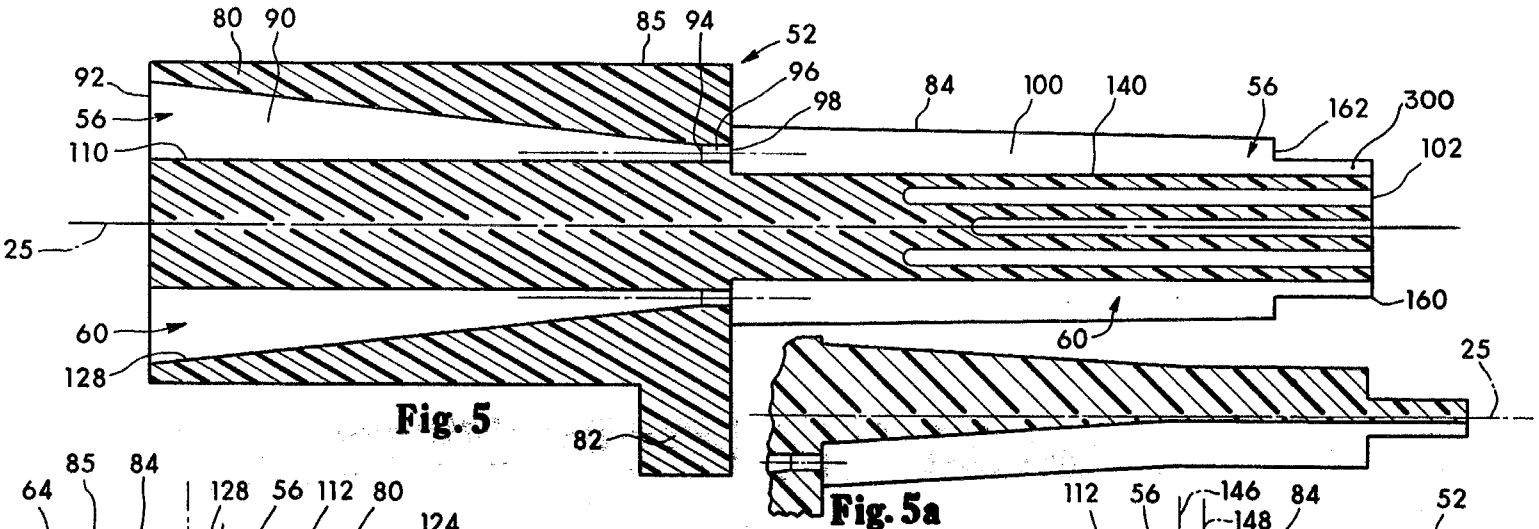
Fig. 5
Fig. 5a
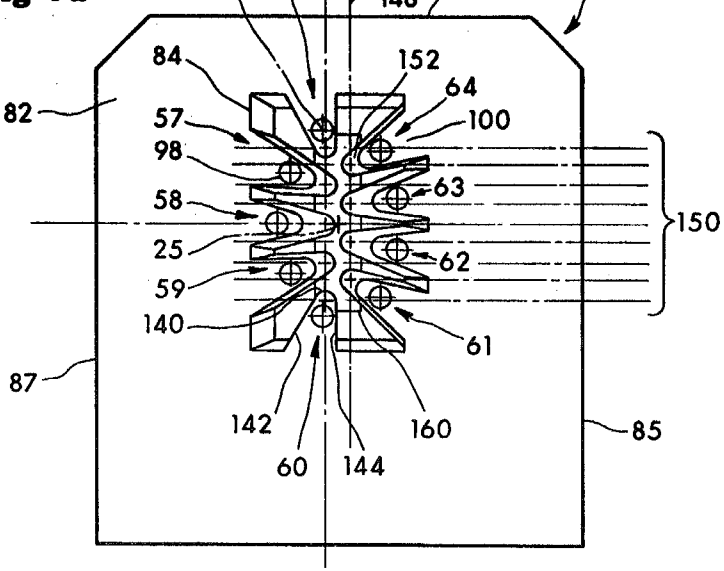
Fig. 6
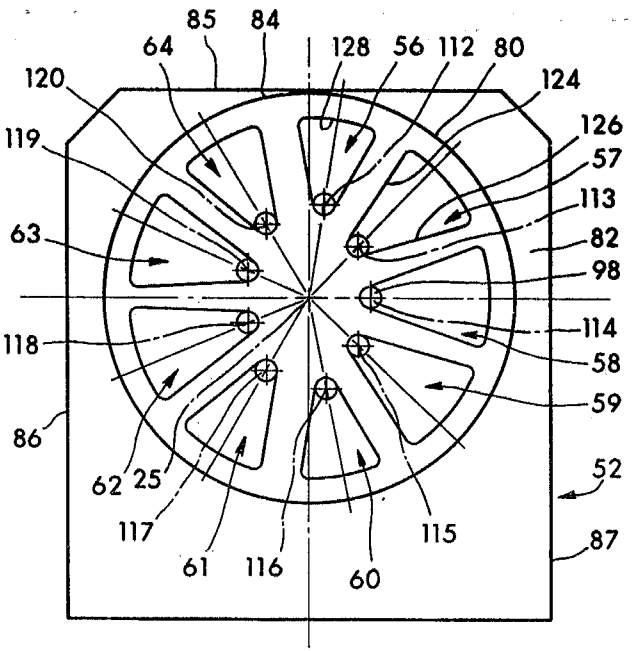
Fig. 7

WIRE MATRIX PRINT HEAD ASSEMBLY

BACKGROUND AND SUMMARY OF INVENTION

This invention relates to wire matrix print head assemblies and, more particularly, to new and improved guide and bearing apparatus for enabling assembly of wire print members by continuous uninterrupted axial movement relative to the guide and bearing apparatus and for enabling accurate reliable reciprocable operation after assembly of the wire print members on accurately located and positioned multiple bearing means portions of the guide and bearing apparatus with the print end portions of the wire members arranged in accurate relatively closely spaced juxtaposition.

In general, the bearing apparatus of prior wire matrix print head assemblies of the type disclosed in my prior U.S. Pat. Nos. 3,939,214, 3,994,381 and 4,051,941 has comprised a pair of axially spaced relatively narrow width intermediate wire support members located in widely axially spaced relationship between an armature end passage and a print end passage in a wire housing portion of the assembly. The assembly of the wire members during manufacture of such print head assemblies and the removal and replacement of wire members for service, maintenance and repair has been tedious, costly and time consuming due to the fact that the wire members have a bowed configuration in the assembled position requiring manual alignment from passage to passage to enable insertion in each of the individual wire passages including not only the intermediate passages but also the print end bearing passage which is conventionally an expensive and fragile ruby or ceramic bearing member requiring careful costly placement relative to the intermediate passages. Furthermore, the wire members must be individually inserted in a predetermined sequence and, consequently, also removed in a predetermined sequence so that repair and replacement of a particular wire member usually also requires removal of additional wire members. The conventional assembly procedure involves the use of special thin tweezers to grip and locate the end of the wire members relative to and prior to being received in each passage after the first armature end passage resulting in interrupted, discontinuous axial movement of the wire members.

One prior attempt to solve these problems has involved the use of a continuous straw-like tube for each wire member having a constant diameter substantially in excess of the diameter of the wire member with the tube being mounted in a flexible bowed condition between the end passages. Among the various problems associated with such a tube are that the axial spacing and location of the intermediate bearing portions, which is critical to performance, cannot be adequately maintained; adequate circumferential bearing support of the wire members at the critical locations cannot be maintained; and the tubular passage tends to create a capillary action during reciprocating movement of the wire members causing flow of ink into the passage whereby the ink in the passage impedes the continued satisfactory performance of the apparatus.

In general, the present invention involves the provision and use of relatively low cost, easily assembled, durable wire bearing means in a wire matrix print head assembly which enables assembly of the wire members by continuous uninterrupted axially directed assembly movement while also providing for accurate bearing support of the wire members at proper positions and locations therealong in the assembled position resulting in improved performance in use. In the presently preferred embodiment, the bearing means comprises two elongated interconnectable separate bearing members, each being made of one piece of molded plastic material having a plurality of axially aligned wire passages which, upon assembly and interconnection of the separate bearing members, provide relatively short length accurately axially spaced bearing means passage portions in a continuous elongated wire guide passage enabling assembly insertion of the wire members by continuous uninterrupted axial movement therealong.

The construction and arrangement of each wire passage is such as to provide a first relatively long length guide means passage portion next adjacent the drive end portion of the wire member which is of enlarged cross-section relative to the diameter of the wire member to enable a first intermediate portion of the wire member to be received therein in a bowed condition and operated therein without restrictive engagement with the side wall of the guide passage portion. A first relatively short length bearing means passage portion is provided at the end of the first guide means passage portion and has a circular cross-section of a diameter slightly larger than the diameter of the wire member to enable free slidable reciprocating movement of the wire member therein while providing circumferentially confining bearing support for a relatively short length intermediate portion of the wire member and also serving to reduce the degree of curvature and change the direction of the wire member. A second relatively long length guide passage means portion is located next adjacent the first bearing means passage portion and has an enlarged cross-section relative to the diameter of the wire member to enable a second relatively long length intermediate portion of the wire member beyond the first bearing means passage portion to be received therein in a lesser bowed condition than the drive end portion of the wire member and operated therein without restrictive engagement with the side wall thereof. A second bearing means passage portion of relatively short length is located next adjacent the second guide passage means and has a cross-section slightly larger than the diameter of the wire member to enable slidable reciprocating movement of the wire member therein while providing confining bearing support for a second relatively short length intermediate portion of the wire member and also serving to reduce the degree of curvature of the second relatively long length intermediate wire portion and change the direction of the wire member from curvilinear to substantially linear. A third relatively long length guide means passage portion is located next adjacent the second bearing means portion, and has an enlarged cross-section relative to the diameter of the wire to enable a third relatively long length intermediate portion of the wire member beyond the second bearing means passage portion to be received therein in an inwardly inclined condition and operated therein without restrictive engagement with the side wall thereof. A third relatively short length terminal bearing means passage portion is located next adjacent the third guide passage portion and has a diameter slightly larger than the diameter of the wire member to enable free sliding reciprocating movement of the print end portion of the wire member therein while providing confining bearing support therefor limiting the reciprocable movement to a linear path with the linear paths of movement of each wire member being parallel.

BRIEF DESCRIPTION OF DRAWING

A presently preferred and illustrative embodiment of the invention is shown in the accompanying drawing in which:

FIG. 5 is an enlarged cross-sectional side elevational view of the central bearing member of the assembly of FIGS. 1 & 2;

FIG. 5*a* is another partial cross-sectional view of the central bearing member;

FIG. 6 is an end view of the bearing member of FIG. 5;

FIG. 7 is another end view of the bearing member of FIG. 5;

DETAILED DESCRIPTION OF INVENTION IN GENERAL

Figures 1, 2, 3, 4:
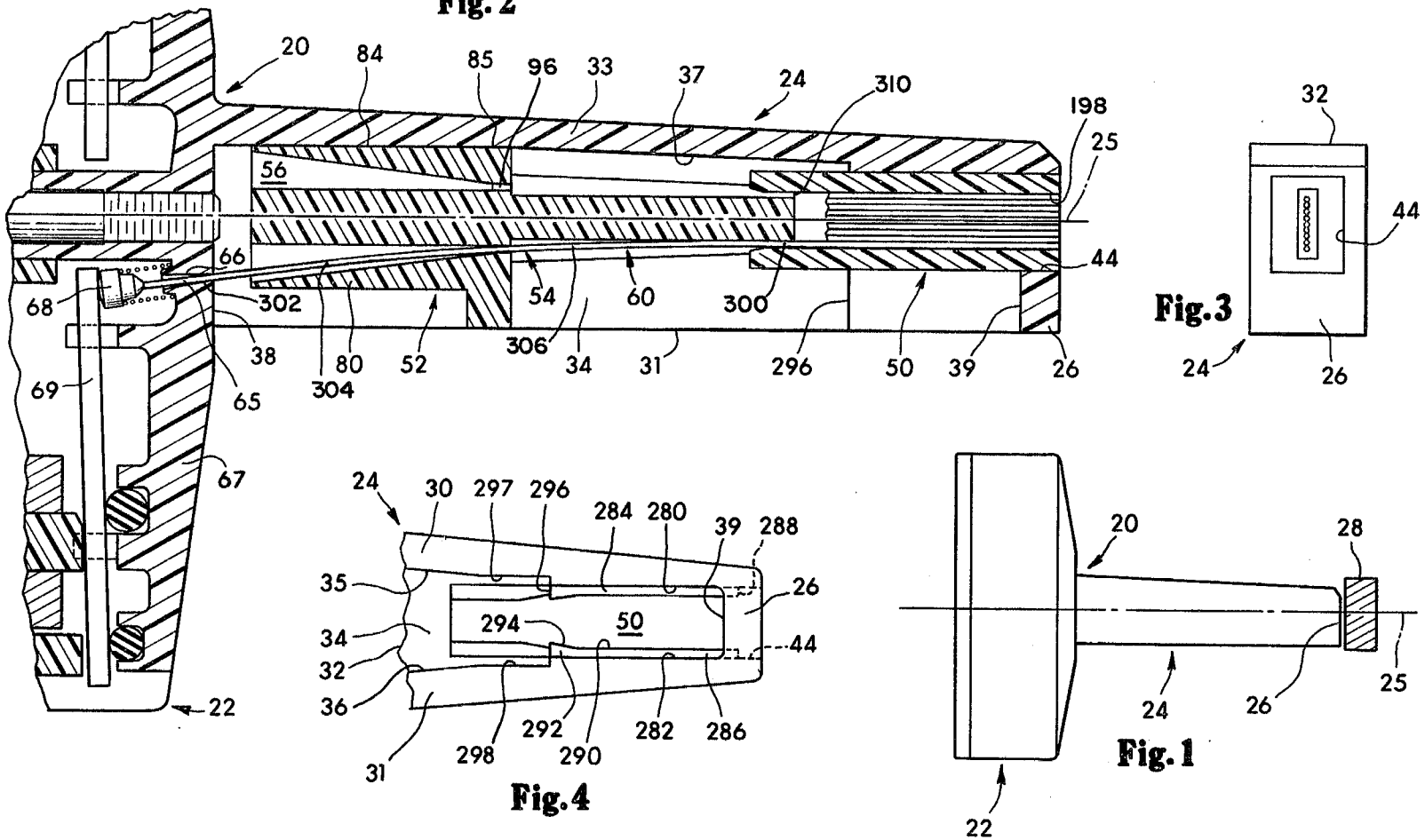
FIG. 1 is a schematic side elevational view of a wire matrix print head assembly.
FIG. 2 is an enlarged cross-sectional side elevational view of a portion of the assembly of FIG. 1.
FIG. 3 is an end view of the print end of the apparatus of FIG. 2.
FIG. 4 is an enlarged partial bottom view of the apparatus of FIG. 1.
Figure 10:
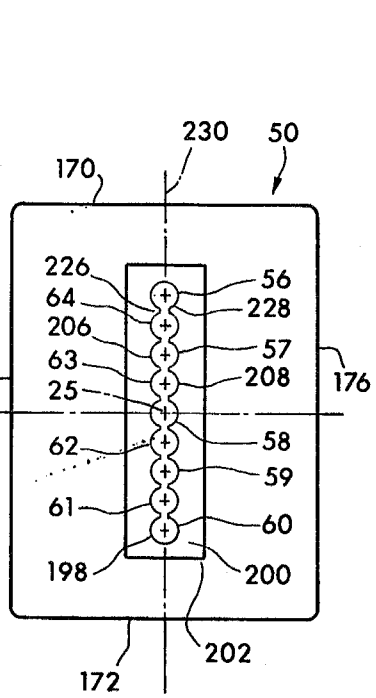
FIG. 10 is an end view of the end bearing member of FIG. 8.
Figure 8:
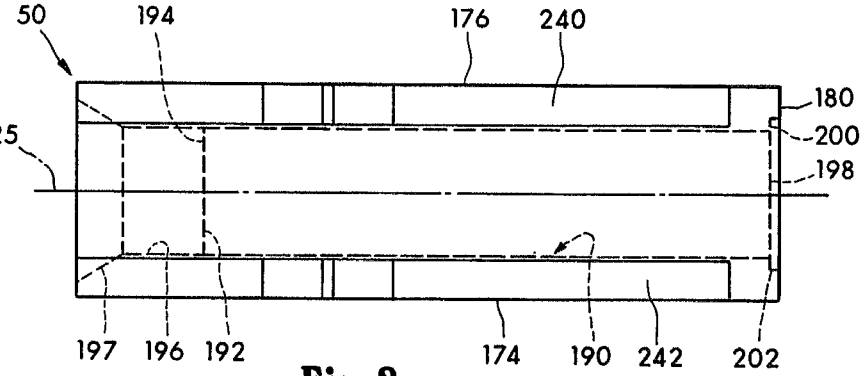
FIG. 8 is an enlarged side elevational view of the end bearing member of the assembly of FIGS. 1 & 2.
Figure 9:
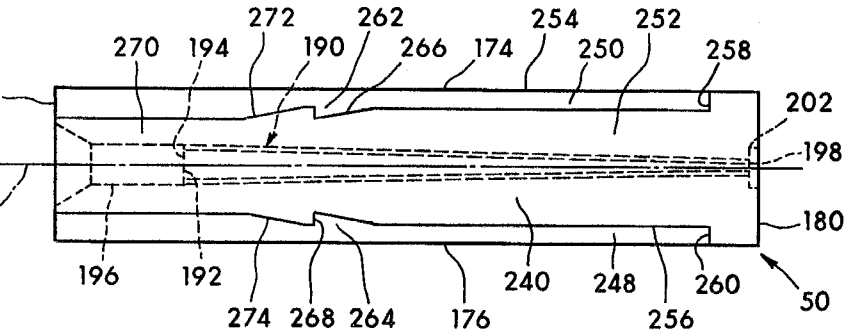
FIG. 9 is a bottom view of the end bearing member of FIG. 8.

In general, the apparatus as shown in FIG. 1 comprises a wire matrix print head assembly 20 having an armature housing portion 22 and a wire guide housing portion 24 extending axially outward along a central longitudinal axis 25 and terminating in a forward transverse end wall portion 26 adapted to be located in juxtaposition to a platen member 28 when operatively mounted within conventional print apparatus (not shown). Referring now to FIGS. 2 and 4–6, the wire guide housing portion 24 comprises a pair of generally parallel spaced flange wall portions 30, 31 connected by a transverse web wall portion 33 to define a generally rectangular cavity 34 between side surfaces 35, 36, 37, 38, 39. A rectangular slot means 44 extends through end wall portion 26 to receive and support a front end wire guide and bearing means member 50. A central wire guide and bearing means member 52 is received in cavity 34 and supported by wall portions 30, 31, 32. Each of a plurality of wire print members 54 are freely reciprocably slidably mounted in one of a corresponding number of separate continuous uninterrupted guide and bearing passage means 56, 57, 58, 59, 60, 61, 62, 63, 64 provided by aligned passage portions in the front end and central guide and bearing means members 50, 52. The rear drive end portions 65 of the print wire members are mounted in guide and bearing passage means 66 in a flange portion 67 of the armature housing means 22. In the illustrative embodiment there are nine such wire members and nine guide and bearing passage means. However, the number of wires and corresponding guide and bearing passage means therefor may be varied as necessary or desirable including special arrangements arranged to print solid line characters which may be optically scanned by known optical carrier recognition apparatus.

Conventional drive head means 68 are mounted on the rear drive end wire portions 65 for operative engagement with armature members 69 operable by electrical coil means 72 as described in prior U.S. Application, Ser. No. 809,423, filed June 3, 1977, the disclosure of which is incorporated herein by reference. The armature housing portion 22 and wire guide portion 24, the front end wire bearing means member 50, and the central wire bearing means member 52 are preferably made of one piece of suitable molded plastic material such as a composite of 30% carbon fibers, 13% polytetrafluoroethylene and 2% silicon in nylon.

The Central Bearing Means Member

Referring now to FIGS. 5–7, the central guide and bearing means member 52 comprises an elongated rearward most cylindrical portion 80, located next adjacent the side wall 38, a central rectangular support flange portion 82, and a forwardmost elongated generally rectangular grooved portion 84 extending toward the front bearing means member 50. The member 52 is suitably fixedly mounted in the cavity 34 with the upper peripheral surface 85 of the cylindrical portion 80 engaging the adjacent portion of inner surface 37 of the web portion 33 and the peripheral surfaces 85, 86, 87 of the flange portion 82 engaging, respectively, the web surface 37 and retaining slots (not shown) along the inner flange surfaces 35, 36 of the housing portion 24. The portion 84 is supported in forwardly extending cantilever fashion from flange portion 82 and is laterally inwardly spaced from the side walls and web portion of cavity 34.

In general, the wire passage portions of each of the wire guide and bearing means passages 56–64 provided in the member 52 comprise a first relatively long guide means passage portion 90 of generally triangular cross-sectional configuration which is gradually reduced in cross-sectional area between an inlet opening 92 and a circular outlet opening 94; a relatively short length bearing means passage portion 96 of uniform circular cross-section having an inlet opening which is the same as the outlet opening 94 and an outlet opening 98; and a relatively long length guide and bearing groove passage portion 100 of generally triangular cross-sectional configuration connected at one end to outlet passage 98 and terminating at the other end in outlet openings 102.

Each wire guide means passage portion 90 comprises an elongated radially innermost arcuate guide surface 110 with centers of curvature located at 112, 113, 114, 115, 116, 117, 118, 119, 120, FIG. 7, and having a radius of curvature slightly larger than the radius of the wire members 54. Guide surfaces 110 extend in parallel linear relationship with one another and the central longitudinal axis 25. Each passage portion 90 further comprises a pair of circumferentially spaced generally radially outwardly extending flat side surfaces 124, 126 tangentially connected by curved inner surfaces 110 and an arcuate radially outermost surface 128 having a center of curvature along the central longitudinal axis 25. The equally spaced centers of curvature 112–120 are arranged in a generally elliptical pattern at varying radial distances from the central longitudinal axis 25. The circumferential and radial location as well as the cross-sectional areas of the passage portions 90 may be varied as necessary or desirable to accommodate the number of wire members used in any particular embodiment.

Each bearing means passage portion 96 has an uniform circular cross-sectional configuration with a radius of curvature equal to and coaxial with the radius of curvature of the arcuate inner surfaces 110 of the guide means passage portions 90 so that the radially innermost surface portions of the circular passage portion 90 are coplanar with the arcuate inner surfaces 110 and arranged in the same generally eliptical pattern as the centers of curvature 112–120. The diameter of bearing means passage portions 96 are slightly larger than the diameter of the wire members 54 to enable free sliding movement therethrough while providing confining circumferential bearing support therefor. In the illustrative embodiment for a wire diameter of 0.0142 inch, the diameter of bearing passage portion 96 is preferably 0.016 inch and the length is approximately 0.03 inch.

Each guide and bearing groove passage portion 100 comprises an elongated radially innermost arcuate guide surface 140 having a radius of curvature (the same as surfaces 110) slightly larger than the radius of the wire members 54 and a pair of outwardly diverging side surfaces 142, 144 extending tangentially from the arcuate inner surface 140. As shown in FIGS. 5 & 6, the cross-sectional configurations and locations of the groove passage portions 100 relative to the central longitudinal axis are varied for the purpose of locating the print end portions of the wire members in a predetermined pattern at the outlet openings 102 whereat, as shown in FIG. 6, the centers of curvature of the arcuate inner surfaces 140 of the groove passage portions 100 of the guide and bearing passage means 56–64 are located in coplanar relationship in two parallel planes represented by lines 146, 148 with five of the centers of curvature located in plane 146, on one side of and closely adjacent to the central axis 25, and four of the centers of curvature located in plane 148 on the other side of and closely adjacent to the central axis 25. Also, as shown in FIG. 6, by the transverse center lines 150, the centers of curvature are equally laterally offset from one another in laterally staggered relationship with adjacent centers of curvature being located in relatively closely spaced lateral relationship. In the illustrative embodiment, the inner surfaces 140 of the groove passage portions 100 of the laterally opposite guide and bearing passage means 56, 60 extend parallel to the central longitudinal axis 25 throughout their length as shown in FIG. 5 while the inner surfaces 140 of the other groove passage portions of the guide and bearing passage means 57, 58, 59, 61, 62, 63, 64 have first inwardly tapered portions 152 of variable length next adjacent the openings 98 and second portions 154 of variable length next adjacent openings 102, FIG. 5*a*, which also extend parallel to the central longitudinal axis 25 and the inner surfaces 140 of the groove passage portions 100 of the passage means 56, 60.

A connecting plug portion 160 of reduced uniform rectangular cross-sectional configuration is provided at the end of the cantilever portion 84 of member 56 with the outlet openings 102 spaced along the periphery thereof and with a transverse abutment surface 162 to provide connecting means for connecting member 52 to member 50. As shown in FIG. 6, the circular extensions of each of the curved surfaces of groove passage portions in plug portion 160 and outlet openings 102 are tangential to the associated side surfaces of the plug portion 160 so that the outer peripheral surface of each wire member is locatable within the confines of the rectangle defined by those side surfaces.

The Front Bearing Means Member

Referring now to FIGS. 8–11, the front guide and bearing means member 50 has an elongated generally rectangular block-like peripheral configuration defined by opposite parallel relatively narrow width upper and/or lower side surfaces 170, 172; opposite parallel relatively wide width side surfaces 174, 176; and opposite parallel end surfaces 178, 180.

In general, the wire passage portions of each of the wire guide and bearing means passages 56–64 provided in the member 50 comprise an elongated tapered passage portion 190 extending between an enlarged wide mouth inlet opening 192 in a transverse end wall 194 of a rectangular connecting socket portion 196 adapted to receive the connecting plug portion 160 of member 52 and a reduced generally circular very short length end bearing means passage 198 having an outlet opening in a laterally inwardly offset transverse end wall 200 of a rectangular end cavity portion 202.

Figure 11:
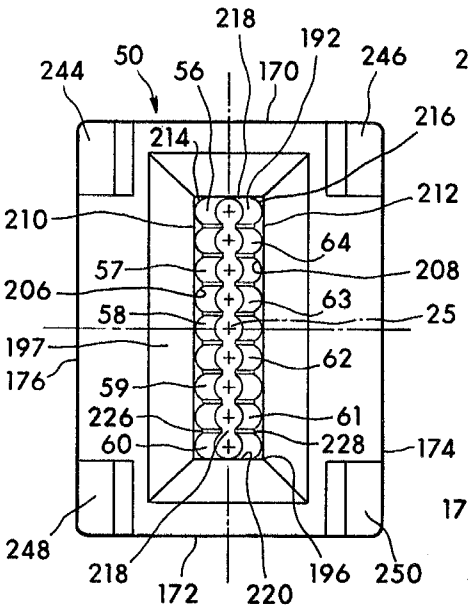
FIG. 11 is another end view of the end bearing member of FIG. 8.

Each inlet opening 192 comprises a pair of oppositely facing semi-circular relatively widely spaced arcuate surfaces 206, 208, FIG. 11, having equal radii of curvature (the same as surfaces 110, 140) slightly greater than the radius of the wire members and spaced apart a distance equal to the width of socket portion 196 as measured between socket side wall portions 210, 212 so as to be tangential therewith and with the side surfaces of the plug portion 160 mounted therewithin. The outer portions 214, 216 of arcuate surfaces 206, 208 of the upper and lower end inlet openings 192 are tangential with socket upper and lower end surfaces 218, 220 and the inner portions 222, 224 are tangential with passage separating rib portions 226, 228 which also separate each of the interior inlet openings 192 and extend tangentially relative to the arcuate surfaces thereof.

Each of the arcuate surfaces and separating rib portions extend the length of the passages 190 and are tapered to gradually reduce the distance between the arcuate surfaces (thus reducing the cross-sectional area of each passage) between the inlet openings 192 and the end bearing passages 198 while maintaining uniform heighth of the passages 190 measured between laterally adjacent rib portions.

Thus, the end bearing passage portions 198 have diameters only very slightly larger than the wire diameter with coplanar centers of curvature located along center line 230 with adjacent passage portions being substantially tangentially located relative to one another whereby each of the wire members are located in closely spaced stacked coplanar alignment along center line 230.

Attachment means are provided along the upper and lower surfaces 174, 176 of member 50 in the form of reduced width rib portions 210, 242 formed by slots 244, 246, 248, 250. Each rib portion comprises a first relatively wide portion 252 having parallel side surfaces 254, 256 intersecting transverse abutment surfaces 258, 260 adjacent the front end of member 50. Notch means 262, 264 are provided in each side surface 254, 256 for receiving cooperating resilient tang means in the wire housing portion 24 as hereinafter described and each notch means comprises an inclined surface 266 and a transverse abutment surface 268. The first wide portion 252 is connected to a second relatively narrow rib portion 270 by inclined cam surfaces 272, 274.

Mounting slot 44 includes attachment and support means provided along the side walls 280, 282, FIGS. 2 & 4, in the form of upper and lower pairs of rib portions 284, 286 extending along and inwardly from the side walls. Each of the rib portions comprises a transverse abutment surface 288 adapted to abut the corresponding one of surfaces 258, 260; a flat side surface 290 adapted to abut the corresponding one of the surfaces 254, 256; and a flat inner surface (not shown) adapted to abut the corresponding one of the surfaces 248, 250. The lower pair of rib portions 284, 286, FIG. 4, have inwardly offset interlocking tang means 292 adapted to be abuttingly received in the notches 262 of the lower pair of slots 298, 250 of member 50 and includes a correspondingly tapered side surface 294 and a transverse abutment surface 296 which extends outwardly to spaced parallel side wall portions 297, 298. The arrangement is such that member 50 may be mounted in slot 44 with surfaces 170, 172 as upper or lower surfaces.

Assembly Of Bearing Means Member

Referring to FIG. 2, the central bearing means member 52 is inserted in the enlarged rear portion of cavity 34, which has a rectangular cross-sectional configuration corresponding to the peripheral configuration of mounting flange portion 82 of member 52 and mounting slots (not shown) formed in the side wall portions 30, 31 to frictionally grip and retain the flange portion 82 therebetween with the upper peripheral surfaces 84, 85 abutting the inner surface 37 of the housing.

The bearing means member 50 is slidably inserted into slot 44 through the front of end flange portion 26 of the wire housing portion 24. The rib portions 284, 286 of the housing portion are slidably received in the slots 244, 246, 248, 250 of the bearing member 50. The rib portions 270, which are of narrower width than the distance between rib portion surfaces 280, 282, are freely movable past tang portions 292. Then inclined surfaces 272, 274 on the rib portions 240, 242 of bearing means member 50 engage the oppositely inclined surfaces 294 on the tang portions. Further inward movement of member 50 causes resilient compression of the tang portions until transverse abutment surfaces 268, 296 become aligned whereupon the housing tang portions 292 are located in the tang slot portions 264 of member 50 with abutment surfaces 268, 296 being engaged and abutment surface 288 of member 50 engaging the abutment surfaces 288 of the housing rib portions 284, 286. In the assembled position, the rear end portion of member 50 extends inwardly beyond the abutment surfaces 296 and is laterally spaced from the inner side wall surfaces of the housing portion 24. The plug portion 160 of member 52 is slidably received in the socket portion 196 of member 50 with tapered surfaces 197 facilitating slidable insertion therein. The peripheral side surfaces of plug portion 160 of member 52 and of socket portion 196 of member 50 are slidably abuttingly engageable to locate and align the passage portions therein with the peripheral side surfaces of the socket portion 196 closing the open portions of groove passage portions 100 in the plug portion 160 to provide intermediate bearing means for the wire members which are laterally confined therebetween and therewithin.

Assembly of Wire Members

Each wire member 54 is assembled through the guide and bearing passage means 66 in the armature housing flange portion 67 prior to assembly of the armature members 69. The wire member print end portion is simply inserted in the passage means 66 and the wire member is pushed axially forwardly in one continuous uninterrupted movement until the assembly movement is completed. As the print end portion leaves passage means 66, it is directed toward a central portion of the inlet opening 92 of guide passage portion 90 in member 52 by the angle of inclination of passage means 66. After the print end portion enters the associated one of the passage portions 90, it is then moved through passage portion 90 into and through the first bearing passage portion 96; then along groove passage portion 100 into a second bearing passage portion 300, FIG. 2, formed by the groove passage portions in the plug portion 160 and the side wall surfaces of socket portion 196; then into the associated wide mouth inlet opening 194 of passage portions 190 and along one of the arcuate side wall surfaces 206, 208 to the associated one of the outlet openings 198. Since the passage means 56–64 are separated from one another throughout their lengths, the wire members may be inserted or withdrawn in any order without interference with any other wire member.

Assembled Position And Operation

In the assembled position, FIG. 2, the drive end portion 65 of each wire member extends in a straight unflexed condition from the drive head 68 through tapered passage 66 and is freely slidably supported and circumferentially confined by a relatively short length reduced diameter first bearing means passage portion 302 having a diameter slightly larger than the wire diameter (e.g., 0.016 inch diameter for a 0.0142 inch wire diameter). A first innermost intermediate wire portion 304 between the outlet opening of bearing means 302 and the inlet opening of bearing means passage portion 96 is mounted in a flexed bowed condition in passage portion 90 in complete circumferentially spaced relationship to the side surfaces 110, 124, 126, 128 of passage portions 90. A relatively short length portion of the wire member is freely slidably supported and fully circumferentially confined by the reduced diameter second bearing means passage portion 96 having a diameter slightly greater than the wire diameter. A second outermost intermediate wire portion 306 between bearing passage portion 96 and bearing passage portion 300 is supported in a lesser flexed bowed condition in groove passage portion 100 between the outlet opening of bearing means passage portion 96 and the inlet opening to bearing means passage portion 300 in circumferentially spaced relationship to the side surfaces 140, 142, 144 of the groove passage. A relatively short length of the wire member is freely slidably supported and fully circumferentially confined by the third bearing means passage portion 300 which has a cross-sectional configuration slightly larger than the wire diameter. The intermediate portions of the wire members between the outlet openings 310 of bearing passage portions 300 and the inlet openings of bearing passage portions 190 are slightly inwardly flexed and circumferentially spaced from surfaces 206, 208 to change the wire member pattern from that of two parallel laterally offset rows of coplanar groups of staggered wire members, illustrated by center lines 146, 148 of FIG. 6, to one row of coplanar aligned closely adjacent wire members illustrated by the passage portions 198 of FIG. 10. A relatively short length portion of each wire member is freely slidably supported and very closely circumferentially confined in bearing means passage portion 198 which has a diameter only very slightly greater than the wire diameter (e.g., 0.0145±0.0002 inch diameter for a 0.0142 inch diameter wire). After the wire members have been assembled, the end surfaces of the print end portions are ground to provide exact alignment. The cavity 200 prevents damage to the bearing means passage 198 during grinding and enables removal of any spurs on print end portions of the wire members adjacent the end surfaces.

Thus, each wire member is supported during reciprocable movement in use by four relatively short length bearing means passage portions 302, 96, 300, 198, the axial spacing and length of each set of bearing means for each wire being uniform and the axial spacing between adjacent pairs of passage portions 302 & 96, 96 & 300, and 300 & 198 being substantially equal whereby approximately equal lengths of the wire member extend between the outlet opening of bearing passage 302 and the inlet opening of bearing passage 96, between the outlet opening of bearing passage 96 and the inlet opening of bearing passage 300, and between the outlet opening of bearing passage 300 and the inlet opening of bearing passage 198.

In the presently preferred illustrative embodiment of the invention, for wire members having a diameter of 0.0142 inch, the bearing means 302 in armature housing means passage 66 have a diameter of 0.016±0.001 inch; the radius of curvature of arcuate surfaces 110 of guide means passage portions 90 is 0.008 inch; the diameter of bearing means passages 96 is 0.016±0.001 inch; the radius of curvature of arcuate surfaces 140 of guide and bearing means passage portions 140 is also 0.016±0.001 inch; and the diameter of bearing means passage portions 198 is 0.0145±0.0002 inch. However, it is to be understood that the inventive concepts may be utilized in other alternative embodiments of the invention and it is intended that the appended claims be construed to include other embodiments of the invention except insofar as limited by the prior art.

What is claimed is:

1. A wire matrix print head assembly having a plurality of elongated wire members, movable between a retracted nonprint position and an extended print position, and a plurality of armature members, operably associated with the wire members to cause movement thereof from the retracted nonprint position to the extended print position, and comprising:

an armature housing means for receiving and supporting the armature members and for receiving and supporting drive end portions of the wire members in operative association with the armature members;

an elongated wire housing means extending axially outwardly from the armature housing means and having a print end portion spaced forwardly of said armature housing means for receiving and slidably reciprocably supporting the wire members; and wire bearing and guide means mounted in said wire housing means for providing a substantially continuous elongated guide and bearing passage for each wire member extending between said armature housing means and the print end portion of said wire housing means for enabling assembly of the wire members by continuous uninterrupted forward movement therethrough and for providing a plurality of relatively short length axially spaced bearing means passage portions for slidably supporting each wire member at fixed axially spaced locations during operation by the armature members from the retracted non-print position to the extended print position; the wire bearing and guide means comprising:

first guide means passage portions of each elongated guide and bearing passage means having wire inlet openings facing and located in juxtaposition to said armature housing means and being arranged in a generally circular pattern and being approximately equally circumferentially spaced relative to one another;

second bearing means passage portions having circular cross-sectional configurations of a diameter slightly larger than the wire diameter and being arranged in a generally elliptical pattern;

the wire inlet openings being of substantially greater cross-sectional area than the wire cross-sectional area; and the first guide means passage portions extending between said inlet openings and the second bearing means passage portion being gradually reduced in cross-sectional area to guide the wire member received therein into the second bearing means passage portion during assembly and mounting the first intermediate portion of the wire member therein after assembly in a bowed condition without restrictive circumferential engagement with the surface of the first guide means passage portion.

2. The invention as defined in claim 1 and wherein:

each of said first guide means passage portions having a radially innermost arcuate wire guide surface coplanar and coaxial with a radially innermost surface portion of the second bearing means passage portion.

3. The invention as defined in claim 1 and further comprising:

third guide means passage portions having wire inlet openings facing and next adjacent and of larger cross-sectional area than the second bearing means passage portions;

fourth bearing means passage portions having generally circular cross-sectional configurations of a diameter slightly larger than the wire diameter and being arranged in two groups in two parallel rows with the centers of each group being coplanar and equally spaced from one another and the centers of alternate ones of both groups being equally spaced from one another;

the third guide means passage portions extending between said wire inlet openings and said fourth bearing means passage portions being radially inwardly inclined to guide the wire member received therein into the fourth bearing means passage portion during assembly and mounting the third intermediate portion of the wire member therein after assembly in a bowed condition without restrictive circumferential engagement therewith.

4. The invention as defined in claim 3 and wherein:

each of said third guide means passage portions having a radially innermost arcuate guide surface coplanar and coaxial with a radially innermost surface portion of said fourth bearing means passage portion.

5. The invention as defined in claim 2 and further comprising:

fifth guide means passage portions having wire inlet openings facing and next adjacent and of larger cross-sectional area than the fourth bearing means passage portions;

sixth bearing means passage portions having generally circular cross-sectional configurations of a diameter very slightly larger than the wire diameter and being arranged in one group in one row with the centers being coplanar and equally spaced from one another a distance only very slightly larger than the wire diameter; and the fifth guide means passage portions extending between said wire inlet openings and said sixth bearing means passage portions being radially inwardly inclined to guide the wire member received therein into the sixth bearing means passage portion during assembly and mounting the fifth intermediate portion of the wire member therein after assembly in an inclined condition without restrictive circumferential engagement therewith.

6. The invention as defined in claim 5 and wherein:

each of said fifth guide means passage portions having a radially outermost arcuate guide surface which have a locus of centers of curvature inclined toward the sixth bearing means portion so as to be coplanar and concentric therewith at the inlet opening thereto.

7. The invention as defined in claim 3 and wherein said elongated bearing and guide means comprising:

a centrally located mounting flange portion having said second bearing means passage portion therewithin;

an elongated cylindrical portion connected to and extending from said mounting flange portion and located next adjacent the armature housing means and having said first guide means passage portion therewithin; and an elongated rectangular cantilever portion connected to and extending from said mounting flange portion and extending toward the print end portion of said wire housing means and having said third guide means passage portion therein.

8. A wire matrix print head assembly having a plurality of elongated wire members, arranged in a generally circular array and being movable between a retracted nonprint position and an extended print position, and a plurality of armature members arranged in a circular array, operably associated with the wire members to cause movement thereof from the retracted non-print position to the extended print position, and comprising:

an armature housing means for receiving and supporting the armature members and for receiving and supporting drive end portions of the wire members in operative association with the armature members;

an elongated wire housing means extending axially outwardly from the armature housing means and having a print end portion spaced forwardly of said armature housing means for receiving and slidably reciprocably supporting the wire members; and wire bearing and guide means mounted in said wire housing means and having a portion located radially inwardly of and a portion located radially outwardly of said wire members for providing a substantially continuous elongated guide and bearing passage for each wire member extending between said armature housing means and the print end portion of said wire housing means for providing a plurality of relatively long length open passage portions for enabling assembly of the wire members by continuous uninterrupted forward movement therethrough which are constructed and arranged to be in spaced non-contacting relationship with said wire members after assembly and during operation by the armature members from the retracted non-print position to the extended print position; and for providing a plurality of relatively short length axially spaced bearing means passage portions for slidably supporting each wire member at fixed axial spaced locations during operation by the armature members from the retracted non-print position to the extended print position.

9. The invention as defined in claim 8 and wherein each elongated guide and bearing passage comprises in sequence between the armature housing means and the print end portion of the wire housing means:

a relatively long length first open guide means passage portion next adjacent the armature housing means for receiving a relatively long length intermediate first portion of the wire member;

a relatively short length second closed bearing means passage portion for supporting a relatively short length intermediate second portion of the wire member;

a relatively long length elongated third open guide means passage portion for receiving a relatively long length intermediate third portion of the wire member; and a relatively short length fourth bearing means passage portion for supporting a relatively short length intermediate fourth portion of the wire member.

10. The invention as defined in claim 9 and further comprising:

a relatively short length end bearing means passage portion for supporting a relatively short length intermediate portion of the wire member next adjacent the print end surface of the wire member.

11. The invention as defined in claim 10 and wherein said wire bearing and guide means comprising:

a first elongated bearing and guide means member mounted in said wire housing means next adjacent the armature housing means; and a second elongated bearing and guide means member mounted in said wire housing means next adjacent said print end portion and being associated with said first elongated bearing and guide means.

12. The invention as defined in claims 1 or 8 and wherein the elongated bearing and guide means being made of one piece of molded plastic material.

13. The invention as defined in claim 12 and wherein:

the wire housing means being made of molded plastic material; and mounting means in said wire housing means for mounting the elongated bearing and guide means by only relative slidable movement and frictional abutting engagement therebetween.

14. The invention as defined in claim 11 and further comprising:

plug and socket means on adjacent end portions of the first and second elongated bearing and guide means members for connection thereof and for continuation of each elongated guide and bearing passage.

15. The invention as defined in claim 14 and wherein:

said first elongated bearing and guide means member including said first open guide means passage portion, said second closed bearing means passage portion, said third open guide means passage portion, and a first part of said fourth bearing means passage portion;

said second elongated bearing and guide means member including a second part of said fourth bearing means passage portion, a fifth open guide means passage portion, and said end bearing means passage portion; and the first and second parts of said fourth bearing means passage portion being located in said plug and socket means.

16. The invention as defined in claim 9 and wherein:

the first open guide means passage portions of each elongated guide and bearing passage means having wire inlet openings facing and located in juxtaposition to said armature housing means and being arranged in a generally circular pattern and being approximately equally circumferentially spaced relative to one another;

the second closed bearing means passage portions having circular cross-sectional configurations of a diameter slightly larger than the wire diameter and being arranged in a generally elliptical pattern;

the inlet openings being of substantially greater cross-sectional area than the wire cross-sectional area; and the first open guide means passage portions extending between said inlet openings and the second closed bearing means passage portion being gradually reduced in cross-sectional area to guide the wire member received therein into the second bearing means passage portion during assembly and mounting the first intermediate portion of the wire member therein after assembly in a bowed condition without restrictive circumferential engagement with the surface of the first open guide means passage portion.

17. The invention as defined in claim 16 and wherein:

each of said first open guide means passage portions having a radially innermost arcuate wire guide surface coplanar and coaxial with a radially innermost surface portion of the second bearing means passage portion.

18. The invention as defined in claim 16 and wherein:

each of the third open guide means passage portions having wire inlet openings facing and next adjacent and of larger cross-sectional area than the second bearing means passage portions;

the fourth closed bearing means passage portions having generally circular cross-sectional configurations of a diameter slightly larger than the wire diameter and being arranged in two groups in two parallel rows with the centers of each group being coplanar and equally spaced from one another and the centers of alternate ones of both groups being equally spaced from one another;

the third open guide means passage portions extending between said wire inlet openings and said fourth closed bearing means passage portions being radially inwardly inclined to guide the wire member received therein into the fourth bearing means passage portion during assembly and mounting the third intermediate portion of the wire member therein after assembly in a bowed condition without restrictive circumferential engagement therewith.

19. The invention as defined in claim 18 and wherein:

each of said third open guide means passage portions having a radially innermost arcuate guide surface coplanar and coaxial with a radially innermost surface portion of said fourth bearing means passage portion.

20. The invention as defined in claim 17 and further comprising:

fifth open guide means passage portions having wire inlet openings facing and next adjacent and of larger cross-sectional area then the fourth closed bearing means passage portions;

the end bearing means passage portions having generally circular cross-sectional configurations of a diameter very slightly larger than the wire diameter and being arranged in one group in one row with the centers being coplanar and equally spaced from one another a distance only very slightly larger than the wire diameter;

the fifth open guide means passage portions extending between said wire inlet openings and said end bearing means passage portions being radially inwardly inclined to guide the wire member received therein into the end bearing means passage portion during assembly and mounting the fifth intermediate portion of the wire member therein after assembly in an inclined condition without restrictive circumferential engagement therewith.

21. The invention as defined in claim 20 and wherein:

each of said fifth guide means passage portions having a radially outermost arcuate guide surface which have a locus of centers of curvature inclined toward the end bearing means portion so as to be coplanar and concentric therewith at the inlet opening thereto.

22. The invention as defined in claim 15 and wherein said first elongated bearing and guide means member comprising:

a centrally located mounting flange portion having said second bearing means passage portion therewithin;

an elongated cylindrical portion connected to and extending from said mounting flange portion and located next adjacent the armature housing means and having said first guide means passage portion therewithin; and an elongated rectangular cantilever portion connected to and extending from said mounting flange portion and extending toward the print end portion of said wire housing means and having said third guide means passage portion therein.

23. The invention as defined in claim 22 and wherein:

said second elongated guide and bearing means member having a generally polygonal cross-sectional configuration;

said print end portion of said wire housing means having a mounting slot therein of generally polygonal cross-sectional configuration corresponding to and receiving and supporting said second guide and bearing means member therewithin.

24. The invention as defined in claim 23 and wherein:

tang and groove means in said mounting slot and on said second guide and bearing means for resiliently frictionally mounting said second guide and bearing means member in said mounting slot.

25. The invention as defined in claim 24 and wherein:

said second guide and bearing means member having a front end surface and an offset cavity portion therein; and the print end portions of the wire members extending into said cavity portion and being aligned with said front end surface.

* * * * *